US005660964A

United States Patent [19]

Machida et al.

[11] Patent Number: 5,660,964

[45] Date of Patent: Aug. 26, 1997

[54] DEVELOPER CONTAINING TWO KINDS OF WAX

[75] Inventors: Junji Machida, Toyonaka; Tetsuo Sano; Yoshitaka Sekiguchi, both of Amagasaki; Chikara Tsutsui, Nishinomiya; Masaaki Takama, Toyonaka, all of Japan

[73] Assignee: Minolta Co., Ltd., Osaka, Japan

[21] Appl. No.: 557,700

[22] Filed: Nov. 13, 1995

[30] Foreign Application Priority Data

Dec. 15, 1994 [JP] Japan ..... 6-311626
Dec. 15, 1994 [JP] Japan ..... 6-311628

[51] Int. Cl.[6] ..... G03G 9/097

[52] U.S. Cl. ..... 430/110; 430/111

[58] Field of Search ..... 430/106, 111, 430/110

[56] References Cited

U.S. PATENT DOCUMENTS

| | | | |
|---|---|---|---|
| 4,810,612 | 3/1989 | Ueda et al. | 430/109 |
| 4,917,982 | 4/1990 | Tomono et al. | 430/99 |
| 5,045,425 | 9/1991 | Swidler | 430/115 |
| 5,079,123 | 1/1992 | Nanya et al. | 430/106.6 |
| 5,124,225 | 6/1992 | Shibata | 430/110 |
| 5,176,978 | 1/1993 | Kumashiro et al. | 430/110 |
| 5,238,797 | 8/1993 | Horiie | 430/110 |
| 5,292,609 | 3/1994 | Yoshikawa et al. | 430/111 |

FOREIGN PATENT DOCUMENTS 0163528 5/1985 European Pat. Off. .

*Primary Examiner*—John Goodrow
*Attorney, Agent, or Firm*—McDermott, Will & Emery

[57] ABSTRACT

A monocomponent developer comprising a binder resin, a colorant and first and second offset preventing agents, wherein a softening point of said binder resin ($Tm_1$), that of said first offset preventing agent ($Tm_2$) and that of said second offset preventing agent ($Tm_3$) satisfies relationship;

$$Tm_2 < Tm_1 \leqq Tm_3$$

a heat quantity change of said first offset preventing agent ($\Delta H_2$) and that of the second offset preventing agent ($\Delta H_3$) satisfies relationship;

$$0.20\ (mJ/mg) \leqq \Delta H_2 - \Delta H_3 \leqq 1.50\ (mJ/mg)$$

A toner comprising a binder resin comprising (a) polyester resin made of etherified diphenol and dicarboxylic acid, and having an acid value of 15 to 50, (b) a colorant, (c) a first offset preventing agent having a softening point of 60° to 110° C. and an acid value of 3 to 45; and (d) a second offset preventing agent having a softening point of 110° to 150° C. and an acid value of 1 to 30.

27 Claims, 4 Drawing Sheets

DEVELOPER CONTAINING TWO KINDS OF WAX

BACKGROUND OF THE INVENTION

1. Field of the Invention

The present invention relates to a developer such as a monocomponent developer, nonmagnetic monocomponent developer, two-component developer and the like for developing electrostatic latent images in electrophotography, electrostatic recording, electrostatic printing and the like.

2. Description of the Related Art

In recent years demand has developed for toners used for image formation which have excellent low-temperature fixing characteristics so as to conserve energy consumption in image forming apparatus. Realizing excellent low-temperature fixing characteristics not only conserves energy consumption by the image forming apparatus, but also reduces the warmup time required from the moment the power source is switched on until developing is possible, thereby providing superior operationality.

Demand has also developed for more compact image forming apparatus. More compact fixing rollers are required in conjunction with compact image forming apparatus. Thus, smaller diameter fixing rollers must be used with the compact image forming apparatus. When the diameter of the fixing roller is reduced, the nip width between pairs fixing rollers is also reduced, thereby creating demand for toner having better fixing characteristics. This demand is particularly acute in the case of low-temperature fixing.

On the other hand, when the fixing roller is made more compactly, the heat capacity of the roller is reduced, such that when power is supplied to the built-in heater of the fixing roller when the image forming apparatus is started, the surface temperature of the roller temporarily attains a high temperature of 200° C. or greater. Therefore, at initial start up of the image forming apparatus, the toner must have high-temperature offset characteristics until the fixing roller temperature reaches a normal temperature which is lower than the above-mentioned peak temperature.

Heretofore, toner using offset preventing agents have been variously proposed in order to obtain a toner which is fixable within a wide temperature range from low temperature to high temperature in accordance with the demand described above. However, since offset preventing agents are the cause of frequent filming on the developing sleeve and photosensitive member, as well as toner fogging, toner having enough performance has not yet to be produced.

For example, Japanese Unexamined Patent Application No. HEI 03-5764 disclosed a toner using a low-melting point carnauba wax having an acid group as a release agent. However, a problem of offset occurs in the high temperature range although suitable offset preventing characteristics are obtained in the low temperature range.

Japanese Unexamined Patent Application No. SHO 60-252366 discloses a toner containing two types of release agents and a binder resin, and proposes combining a non-polar wax and a wax having an acid group. This invention, however, has disadvantages insofar as in methods which develop by regulating the amount of toner on the surface of a toner-bearing member which are typical of nonmagnetic monocomponent developing methods, free wax causes filming of the toner-bearing member, thereby producing image noise such as reduced image density and the like.

Therefore, it is difficult to eliminate the aforesaid disadvantages by simply using two types of offset preventing agent as described above.

When viewed from the perspective of a compact form-factor of the image forming apparatus, however, monocomponent developing methods which do not use a carrier is beneficial. Monocomponent developers do not require mixing mechanisms because they do not use carriers, and such developers can produce stable images by means of simple and compact developing devices because carrier replacement is unnecessary. Until now, however, a monocomponent developer having adequate fixing characteristics has not been available.

SUMMARY OF THE INVENTION

A main object of the present invention is to provide a developer having an excellence not heretofore seen.

Another object of the present invention is to provide a developer suitable for compact, energy conserving image forming apparatus.

Another object of the invention is to provide a developer having excellent low-temperature fixing characteristics.

Still another object of the invention is to provide a developer which does not cause high temperature offset.

Yet another object of the invention is to provide a developer having a broad non-offset range.

A further object of the invention is to provide a developer capable of fixing from low temperatures to high temperatures.

A still further object of the invention is to provide a developer which does not cause filming of the electrostatic latent image-bearing member such as a photosensitive member and the like.

An even further object of the present invention is to provide an excellent monocomponent developer.

An even further object of the present invention is to provide an excellent toner.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
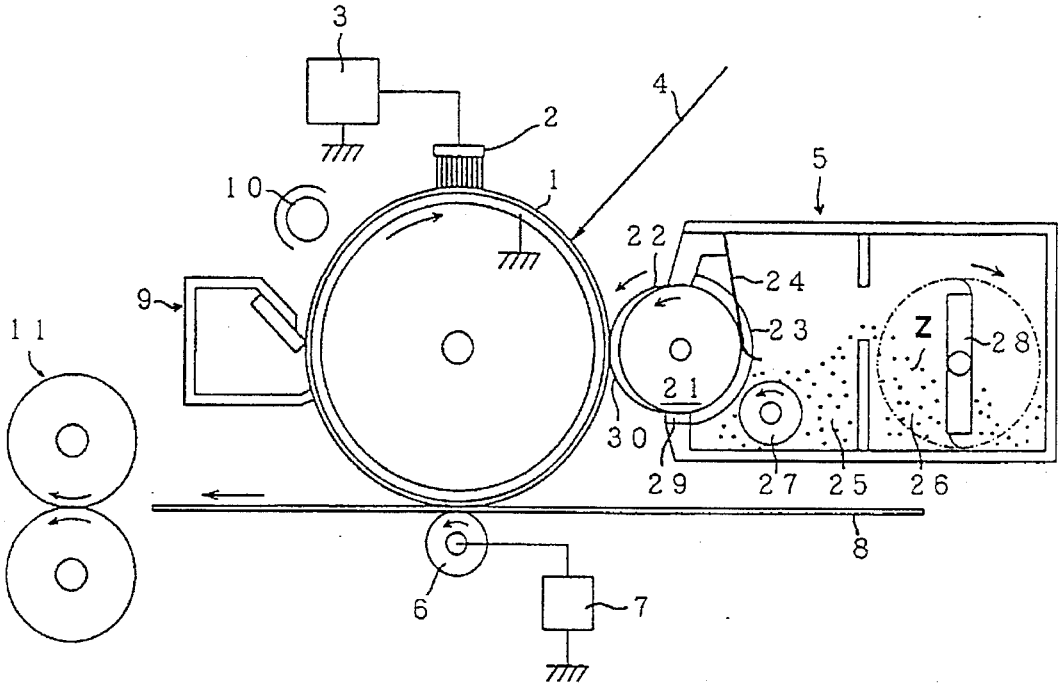
FIG. 1 briefly shows the construction of an image forming apparatus.

The preferred embodiment of the present invention is a developer comprising a toner which comprises at least a binder resin, two types of offset preventing agent, and a colorant.

Two types of offset preventing agent are used for the purpose of preventing low-temperature offset and preventing high-temperature offset. Hereinafter, the offset preventing agent used to prevent low-temperature offset is referred to as "first offset preventing agent," and the offset preventing agent used to prevent high-temperature offset is referred to as "second offset preventing agent."

If the binder resin softening point is designated $Tm_1$, the softening point of first offset preventing agent is designated $Tm_2$, and the softening point of second offset preventing agent is designated $Tm_3$, then when these softening points satisfy the relationship (I) below, $$Tm_2 < Tm_1 \leqq Tm_3 \quad \text{(I)}$$

offset can be prevented across a broad fixing range from low temperature to high temperature, and a toner having a broad non-offset range is particularly desirable as a monocomponent developer.

Examples of materials useful as first offset preventing agent include carnauba wax, Fischer-Tropsch wax, rice wax, candelilla wax, jojoba oil wax, beeswax, polyethylene wax, oxidized polyethylene wax and the like.

In particular, materials having a softening point lower than the binder resin, and preferably having a softening point at least 10° C. lower, are desirable as first offset preventing agent. It is desirable that the wax used is such that the softening point of the wax itself is 60°~110° C., and preferably 80°~100° C. When an offset preventing agent is used which has a softening point higher than the softening point of the resin, there is concern that anti-offset performance will not be obtained in the temperature range lower than the softening point of the binder resin.

Examples of materials useful as second offset preventing agent include polyethylene wax, polypropylene wax, oxidized polyethylene wax, oxidized polypropylene wax and the like. Among the aforesaid waxes, particularly desirable materials have a softening point equal to the binder resin, and preferably have a softening point 10° C. or more higher than the binder resin. It is desirable that the wax used is such that the softening point of the wax itself is 110°~150° C., and preferably 130°~150° C. When an offset preventing agent is used which has a softening point lower than the softening point of the resin, there is concern that anti-offset performance will not be obtained in the temperature range higher than the softening point of the binder resin.

In this specification, the softening point is a value measured by differential scanning calorimeter (DSC).

The first offset preventing agent is desirably added at a rate of 1~6 parts-by-weight, and preferably 2~5 parts-by-weight, with respect to 100 parts-by-weight of the binder resin. The second offset preventing agent is desirably added at a rate of 0.5~5 parts-by-weight, and preferably 1~3 parts-by-weight, with respect to 100 parts-by-weight of the binder resin, desirable total amount of both offset preventing agents is 2~7 parts-by-weight, and preferably 3~5 parts-by-weight, with respect to 100 parts-by-weight of the binder resin. When the added amount is less than 2 parts-by-weight, inadequate anti-offset effectiveness may be attained, whereas when said added amount is greater than 7 parts-by-weight, toner fluidity characteristics may be adversely affected.

Containing first offset preventing agent more than second offset preventing agent is desirable from the perspective of low-temperature fixing characteristics and offset prevention during low-temperature fixing. In this instance, the acid value of first offset preventing agent is desirably larger than the acid value of second offset preventing agent from the perspective of dispersibility.

The acid value of the first offset preventing agent is desirably 3~45, and preferably 3~35 and that of the second offset preventing agent is desirable 1~30, and preferably 2~20.

When material having a polarity is used as an offset preventing agent and a polyester resin is used as the binder resin, the compatibility of both materials is excellent inasmuch as polyester resin has a polarity, such that the added offset preventing agent adheres to the photosensitive member so as to effectively prevent the problem of filming by the polyester resin.

In the standpoint of acid value, it is desirable using carnauba wax, Fischer-Tropsch wax, rice wax, candelilla wax, jojoba oil wax, beeswax, oxidized polyethylene wax as first offset preventing agent, and using oxidized polyethylene wax, oxidized polypropylene wax as second offset preventing agent.

It is desirable that the first and second offset preventing agents exhibit two endothermic peaks within a range of 80° C.~150° C. when the toner is measured by differential scanning calorimeter (DSC). That is, the change in the heat quantity $\Delta H_2$[mJ/mg] measured by DSC of first offset preventing agent and the change in the heat quantity $\Delta H_3$[mJ/mg] measured by DSC of second offset preventing agent is desirably adjusted by selecting various constituent and manufacturing methods so as to satisfy the following relational expression (II).

$$0.20 \leqq \Delta H_2 - \Delta H_3 \leqq 1.50 \quad \text{(II)}$$

The reason for the endothermic peaks being within the range of 80° C.~150° C., is to broaden the non-offset range. When $\Delta H_2$ and $\Delta H_3$ do not satisfy the aforesaid relational expression, there is concern that adequate low-temperature fixing characteristics cannot be assured in compact fixing rollers; this is discussed more fully later.

Differential scanning calorimetry (DSC) is a method which, under identical conditions controls the heating and cooling of specimens and reference substance, and records the energy required to maintain zero temperature difference between said specimen and substance relative to time or temperature. The procedure for measuring the change in the heat quantity $\Delta H$ of an unknown specimen is briefly described below.

(1) Determine the apparatus constant (specimens used to determine the apparatus constant have known purity). When the heat of this specimen changes, part of this change is transmitted to a heat fluctuation detection mechanism (e.g., heat sensitive plate, thermocouple or the like), and part is transmitted outside the detection mechanism. A chart on the recording device shows the heat fluctuation transmitted to the heat fluctuation detection mechanism, such that the true heat change of the specimen must be determined by the following equation;

$$M \cdot \Delta H = K \cdot A$$

(where M is the weight of the specimen (mg), $\Delta H$ is the quantity of energy change per unit quantity of specimen (mcal/mg), K is the apparatus constant (mcal/mcal*), and A is the peak surface area (mcal*); mcal* expresses the heat quantity obtained from the surface area of the measurement chart. $\Delta H$ determines the apparatus constant K if a known specimen M is measured, and the measured surface area of the peak corresponds to $\Delta H$.

(2) Weigh the weight M (mg) of an unknown specimen before DSC measurement.

(3) Determine peak surface area A (mcal). Consider the following three methods for determining peak surface area: i) use a planimeter; ii) count the number of cells in the grid; iii) weigh the cut recording paper.

(4) Substitute values in the expression $M \cdot \Delta H = K \cdot A$ to determine the amount of change in the specimen $\Delta H$.

In this specification, the measurement values obtained under specific measurement conditions are described in the evaluation section of the experimental examples described later.

The toner binder resin may be a styrene resin, styrene-acrylic resin, polyester resin and the like, and it is desirable that the resin used have a softening point of 80°~140° C., and preferably 90°~130° C., from the perspective of assuring low-temperature fixing characteristics. When a resin is used which has a softening point higher than 140° C., there is concern of adverse affects on low-temperature fixing characteristics, whereas when a resin is used which has a softening point less than 80° C., there is concern of adverse affects on offset characteristics and storage stability (heat resistance). Particularly when used as a monocomponent developer, it is desirable that the selection be made such that the relationship of the softening points of the two types of offset preventing agents remains uniform.

When used as a negatively chargeable toner, it is desirable that a polyester resin is used as the binder resin. Negatively chargeable toner is used in image forming apparatus using standard developing methods and provided with a positively chargeable photosensitive member such as an a-Si photosensitive member, and image forming apparatus using a reversal developing method and provided with a negatively chargeable photosensitive member such as an organic photosensitive member. Polyester resin has a natural negative polarity and is therefore suitable for use as a binder resin in a negatively chargeable toner. Nonmagnetic monocomponent developing methods are more convenient than two-component developing methods with respect to the demand for more compact image forming apparatus. In nonmagnetic monocomponent developing methods, however, the toner is charged as it passes through the pressure contact area between the developing sleeve and the toner regulating blade and, therefore, the use of polyester resin is desirable from the standpoint of preventing toner retention on said blade and sleeve.

Polyester resin is formed by a polyol component and a dicarboxylic acid component. The polyol component contains at least etherified diphenol. Examples of useful etherified diphenol include adducts of bisphenol A or di-(4-hydroxyphenyl) methane, and a compound selected from a group comprising ethylene oxide, propylene oxide, diethylene glycol, triethylene glycol, polyethylene glycol, dipropylene glycol, polypropylene glycol, polytetramethylene ether glycol, glycerol, trimethylol propane, pentaerythritol, tripentaerythritol. Examples of useful dicarboxylic acid component include maleic acid, fumaric acid, mesaconic acid, citraconic acid, itaconic acid, glutaconic acid, phthalic acid, isophthalic acid, terephthalic acid, succinic acid, adipic acid, sebacic acid, malonic acid, 1,2,4-benzene tricarbonic acid, 1,2,5-benzene tricarbonate acid, 1,2,4-cyclohexane tricarbonate acid, 1,3-dicarboxy-2-methyl-2-methylcarboxypropane tetra(methylcarboxy)methane.

In the synthesis of the polyester resin, a plurality of types of polyol components and dicarboxylic acid components may be mixed. Furthermore, a plurality of polyester resins may be used in the toner.

In addition, a urethane-modified polyester resin obtained by reacting isocyanate with the polyester resin may be used.

The acid value of the polyester resin is desirably 15~50, and preferably 20~40. When the acid value is less than 15, there is concern about reduced dispersability of the first and second offset preventing agents, whereas when the acid value is greater than 50, there is concern about reduced environmental stability of the toner charge.

Adjustment of the acid value can be achieved by adjusting the ratio of the polyol component and the carbonate acid component comprising the polyester resin.

Particularly when used as a monocomponent developer, the polyester resin comprising an etherified diphenol and dicarboxylic acid as the main components will preferably have a glass transition temperature (Tg) of 55° C.~70° C., an acid value of 10~40, and a softening point of 80° C.~140° C.

The toner may be obtained by well-known methods, e.g., adding, in addition to binder resin and offset preventing agents, various additives such as colorant, charge-controlling agent and other desired additives in predetermined amounts, and mixing and kneading, and subsequently pulverizing and classifying said material.

Useful colorants include various pigments commonly used in electrophotography, such as the examples mentioned below.

Examples of black color pigments include carbon black, copper oxide, manganese dioxide, aniline black, activated carbon, magnetite and the like.

Examples of useful yellow pigments include chrome yellow, zinc yellow, cadmium yellow, yellow oxide, mineral fast yellow, nickel titanium yellow, naples yellow, naphthol yellow S, Hansa yellow G, Hansa yellow 10G, benzidine yellow G, benzidine yellow GR, quinoline yellow lake, permanent yellow NCG, tartrazine lake and the like.

Examples of useful red pigments include chrome orange, molybdenum orange, permanent orange GTR, pyrazolone orange, vulcan orange, indanthrene brilliant orange RK, benzidine orange G, indanthrene brilliant orange GK, red oxide, cadmium red, red lead, permanent red 4R, lithol red, pyrazolone red, watchung red, lake red C, lake red D, brilliant carmine 6B, eosin lake, rhodamine lake B, alizarine lake, brilliant carmine 3B, permanent orange GTR, vulcan fast orange GG, permanent red F4RH, permanent carmine FB and the like.

Examples of useful blue pigments include prussian blue, cobalt blue, alkaline blue lake, victoria blue lake, phthalocyanine blue and the like.

The amount of added colorant is desirably 1~20 part-by-weight, and preferably 3~15 parts-by-weight relative to 100 parts-by-weight of resin in the toner.

From the perspective Of application to the previously mentioned negative charging toner, use of a negative charge-controlling agent is desirable, e.g., azo dye chrome complex salts, copper phthalocyanine dye, chrome complex salt, zinc complex salt, aluminum complex salt, quaternary ammonium salts and the like. The amount of the added charge-controlling agent is desirably 0.5~8 parts-by-weight, and preferably 1~5 parts-by-weight relative to 100 parts-by-weight of toner binder resin.

In addition, resin beads may be added to the toner as fluidizing agent and cleaning enhancers as necessary.

Examples of useful fluidizing agents include fine silica particles, titanium dioxide fine particles, alumina fine particles, magnesium fluoride fine particles, silicon carbide fine particles, boron carbide fine particles, titanium carbide fine particles, zirconium carbide fine particles, boron nitride fine particles, titanium nitride fine particles, zirconium nitride fine particles, magnesium fine particles, molybdenum disulfide fine particles, aluminum stearate fine particles, magnesium stearate fine particles, zinc stearate fine particles and the like. These fine particles are preferably subjected to hydrophobicity imparting treatment by silane coupling agent, titanium coupling agent, higher fatty acid, silicone oil and the like.

The amount of fluidizing agent is desirably 0.05~5 parts-by-weight, and preferably 0.1~3 parts-by-weight relative to 100 parts-by-weight of toner.

Vapor phase method or wet polymerization method such as emulsion polymerization, soap-free emulsion polymerization, nonaqueous dispersion polymerization and the like may be used to produce various organic fine particles such as styrene, acrylic, methacrylic, benzoguanamine, silicone, teflon, polyethylene, polypropylene and the like which may be used individually or in combination.

The developer of the present invention is applicable to nonmagnetic monocomponent developing devices and image forming apparatus having the construction, for example, briefly shown in FIG. 1.

In FIG. 1 electrostatic latent image-bearing member 1 (hereinafter referred to as "photosensitive drum") comprises a photosensitive layer superimposed on a conductive substrate., and is rotated in the arrow direction in the drawing.

A charging member, i.e., charging brush 2, is provided so as to make contact with the surface of photosensitive drum 1. The surface of photosensitive drum 1 is charged to predetermined polarity and surface potential by a predetermined charging voltage supplied to charging brush 2 by a power source 3.

Image exposure light 4 forms an electrostatic latent image on the surface of photosensitive drum 1 which has been charged to a predetermined potential, and said latent image is developed by nonmagnetic monocomponent developing device 5 so as to form a toner image. Monocomponent developing device 5 is described fully below.

A transfer member, i.e., transfer roller 6, is formed with a conductive elastic layer superimposed on a metal core, and presses against the photosensitive drum 1 with a predetermined pressure while rotating in the arrow direction in the drawing. A bias voltage having a polarity opposite the charge polarity of the toner is applied to transfer roller 6 by power source 7. Transfer member 8 is connected between photosensitive drum 1 and transfer roller 6, and is supplied the aforesaid bias so as to transfer the toner image on the surface of photosensitive drum 1 onto transfer member 8.

Transfer member 8 bearing the transferred toner image on the surface thereof is transported to a fixing device provided with a pair of fixing rollers 11 (spring pressure 4.5 kg) comprising a heating roller (diameter 20 mm) with built-in heater and a pressure roller (diameter 20 mm) pressed against said heating roller. The toner image on the surface of the transfer member 8 is fixed thereon by passing between said pair of fixing rollers 11.

After the toner image has been transferred, the surface of photosensitive drum 1 is cleaned by cleaning device 9 provided with a cleaning blade so as to remove residual toner and foreign matter such as paper dust and the like. Then, the surface of photosensitive drum 1 is discharged by discharger 10 in preparation for the next image forming process.

Monocomponent developing device 5 using the toner of the present invention described above is provided with a drive roller 21 which is rotatably driven in the arrow direction in the drawing by a drive means not shown in the illustration. This drive roller 21 is sheathed by a flexible developing sleeve 22 which has an internal diameter slightly larger than the external diameter of said drive roller. Both ends of developing sleeve 22 is pressed against drive roller 21 from behind by pressure guides 23, such that a slack portion 30 is formed on the side opposite said pressure contact so as to make light contact with photosensitive drum 1. A toner regulating blade 24 makes contact with developing sleeve 22 from the same side as pressure guides 23.

Behind developing sleeve 22 are provided a buffer compartment 25 and toner supply compartment 26 is provided behind compartment 25. A rotatable toner supplying member 27 is provided in buffer compartment 25, and a rotatable toner mixing member 28 is provided in toner supply compartment 26.

Below developing sleeve 22 is provided a bottom seal member 29 to prevent toner leakage from buffer compartment 25.

According to the aforesaid developing device, nonmagnetic monocomponent developer Z is supplied from toner supply compartment 26 to buffer compartment 25 via the rotation of member 28, developer Z being sequentially supplied to the surface of developing sleeve 22 via the rotation of toner supply member 27.

On the other hand, developing sleeve 22 is driven in rotation by means of the friction force in conjunction with the rotation of drive roller 21, and the developer Z supplied to the sleeve is triboelectrically charged under pressure with blade 24 as it passes between toner regulating blade 24 and sleeve 22, such that developer Z is formed in a thin layer of predetermined thickness. This thin toner layer is maintained on the surface of developing sleeve 22 and transported to a developing region which confronts photosensitive drum 1, so as to develop an electrostatic latent image formed on said drum 1.

Excess toner remaining on the surface of developing sleeve 22 after development passes between developing sleeve 22 and intermediate seal member 29 via the rotation of sleeve 22 so as to be returned to buffer compartment 25.

Although the toner of this embodiment has been described in terms of a nonmagnetic monocomponent developing device, it is not limited to such use. In the developing device of FIG. 1, for example, the developing sleeve 22 is formed with a slack portion 30 having an internal diameter larger than the external diameter of a drive roller, but it is possible to use a developing sleeve lacking the aforesaid slack portion and having an internal diameter equal to the external diameter of said drive roller.

Figure 2:
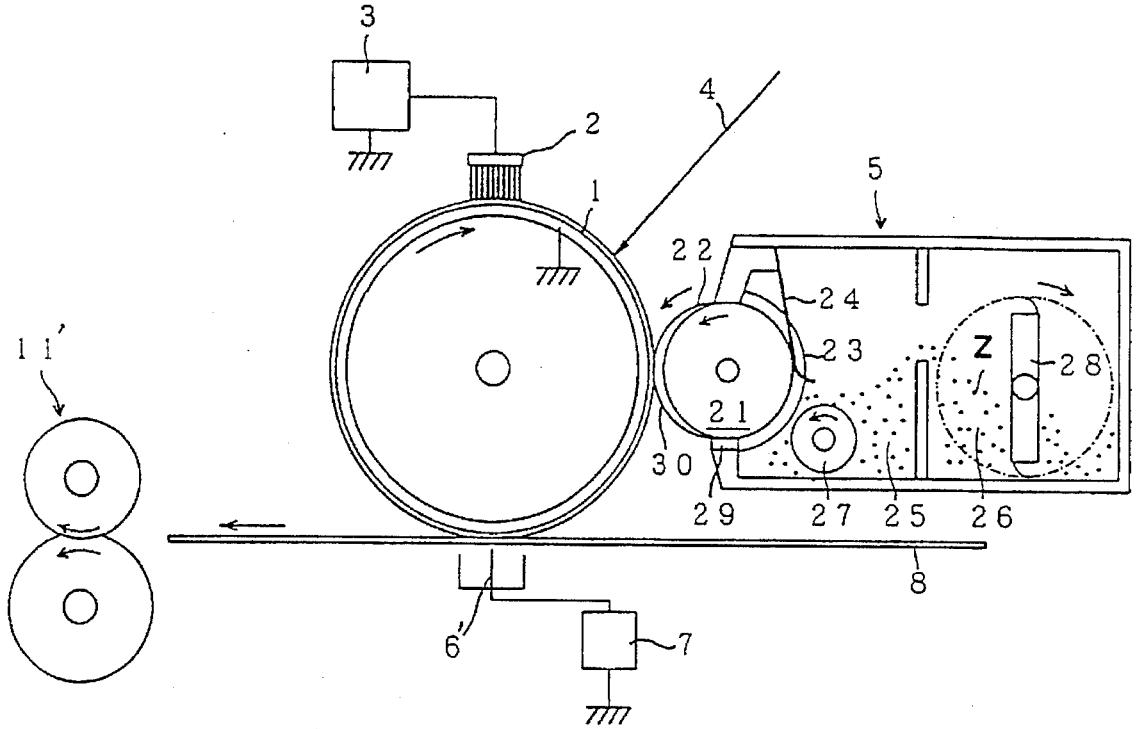
FIG. 2 shows a modification of the image forming apparatus.

The image forming apparatus using the toner of the present invention is not limited to the apparatus of FIG. 1, inasmuch as an image forming apparatus provided with the construction of FIG. 2 may be used.

The image forming apparatus of FIG. 2 is an inexpensive model which is not provided with the cleaning device 9 or discharger 10 provided in the image forming apparatus of FIG. 1. Developing device 5 collects residual toner and develops electrostatic latent images, and charging brush 2 charges and discharges photosensitive drum 1. The transfer device is provided with a needle electrode 6' which is supplied a bias having a polarity opposite the charge polarity of the toner via power source 7. The pair of fixing rollers 11' (spring pressure 6.2 kg) of the fixing device comprise a heating roller provided with an internal heater (not illustrated) and a pressure roller which presses against said heating roller. The diameter (16 mm) of the pressure roller is smaller than the diameter (20 mm) of the heating roller. Thus, the fixing nip width is broadened by the aforesaid construction so as to improve the fixing characteristics for thick paper.

A fixing device suitable for use with the toner of the present invention in a compact image forming apparatus will desirably have a fixing roller diameter of less than 25 mm, and preferably 10~20 mm, and a spring pressure of 3.0~8.0 kg.

Experimental examples of the present invention are described hereinafter.

Experimental Example 1

(1) Production of low-molecular weight polyester resin

A reflux condenser, moisture separator, $N_2$ gas tube, and mixing device were attached to a 5 liter capacity 4-mouth flask and installed on a mantle heater, and 1,376 g of bisphenol propylene oxide, 659 g of isophthalic acid, and 90 g diethylene glycol were introduced to the flask. As $N_2$ gas was introduced to the flask, the material was subjected to dehydration polycondensation at 220° C. to 270° C., to obtain a low-molecular weight polyester resin.

(2) Production of polyester resin for further polymerization

A reflux condenser, moisture separator, $N_2$ gas tube, and mixing device were attached to a 5 liter capacity 4-mouth flask and installed on a mantle heater, and 1,720 g of bisphenol propylene oxide, 1,028 g of isophthalic acid, 328 g of 1,6-dipropyl-1,6-hexane diol, and 74.6 g of glycerin were introduced to the flask. As gas was introduced to the flask, the material was subjected to dehydration polycondensation at 240° C. to obtain a polyester resin for further polymerization.

(3) Production of urethane-modified polyester resin

To 80 parts-by-weight of said low-molecular weight resin was added 20 parts-by-weight of said polyester resin for further polymerization, and the materials were uniformly mixed by henschel mixer. Then, 40 parts-by-weight diphenylmethane-4,4-diisocyanate was added and reacted for 1 hr at 120° C. by a heating kneader. After the absence of residual free isocyanate group was confirmed by measuring the NCO percentage, the resultant urethane-modified polyester resin was obtain (glass transition temperature (Tg) of 63.5° C., softening point of 115° C., acid value of 26). The obtained urethane-modified polyester resin was used to produce the toner described below.

(4) Toner production

| | Parts-by-weight |
|---|---|
| Urethane-modified polyester resin | 100 |
| Carbon black (Mogul L; Cabot) | 5 |
| Charge-controlling agent (S-34; Oriental Chemicals) | 2 |
| First offset preventing agent (Carnauba wax; softening point 85° C. acid value 4; Kato Yoko Co.) | 1.5 |
| Second offset preventing agent (Biscol TS-200A; softening point 148° C. acid value 2.0; Sanyo Kasei K.K.) | 1.0 |

The aforesaid materials were mixed using a henschel mixer, then kneaded using a twin-shaft extrusion kneader. The kneaded material was cooled, and coarsely pulverized, then finely pulverized using a jet mill type fine pulverization device.

The obtained finely pulverized material was classified using a forced air classification device to obtain particles having a mean particle size of 8.6 μm (3.8% less than 5 μm, and 0% greater than 20 μm). The obtain particles had a heat fluctuation difference $\Delta H_2-\Delta H_3$ of 0.63 mJ/mg measured by DSC.

$\Delta H_2$ is the peak DSC heat absorption of first offset preventing agent, and $\Delta H_3$ is the peak DSC heat fluctuation of second offset preventing agent.

In this embodiment, the change in the heat quantity AH of offset agents measured by DSC are measured by a differential scanning calorimeter (DSC 200; Seiko Denshi Kogyo K.K.).

Figure 3:
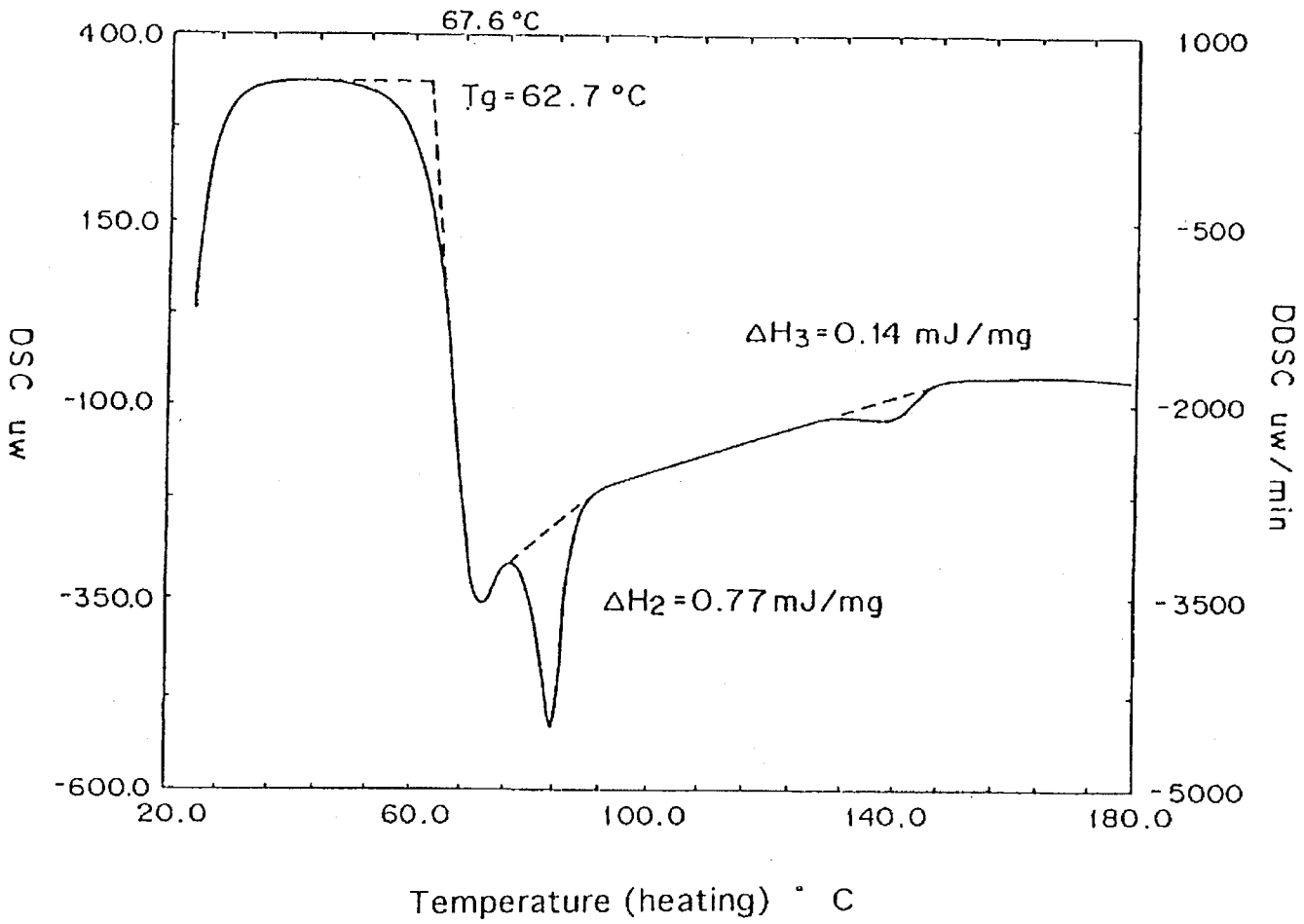
FIG. 3 is a differential scanning calorimeter (DSC) curve of first embodiment developer.

Toner was placed in an aluminum pan and heated to 200° C. at a rate of 30° C./min, maintained at that temperature for 2 min, and subsequently rapidly cooled under ice to room temperature. The glass transition temperature Tg was determined by raising the temperature to 185° C. at a rate of 10° C./min after temperature stabilization, and the value of ΔH of the wax was determined from the obtained data. The DSC chart is shown in FIG. 3.

To the aforesaid particles was added 0.5 percent-by-weight hydrophilic silica H-2000 (Hoechst), and the materials were processed in a Henschel mixer for 60 sec at 2,500 rpm to obtain toner particles A.

(5) Evaluation (a) Continuous Print Test

A teflon coated roller was provided as the fixing roller, and toner particles were loaded in an improved printer model SP-1000 (Minolta Co., Ltd.) as a monocomponent developer. The printer has variable roller temperature settings. Then, continuous printing was performed with the fixing temperature set at 130° C. Excellent images were produced from the initial printing and throughout 6,000 sheets without offset or soiling of the fixing roller. The fixing device used in the SP-1000 printer at this time comprised a top roller having a diameter of 20 Φ (teflon resin coating), and a bottom roller of 20 Φ (silicone rubber), and spring pressure of 4.5 kg.

(b) Non-offset range

The roller temperature was between 90°~230° C. in 5° C. increments, the toner image was fixed, and the temperature range within which offset did not occur was determined. Result is shown in Table 2. The non-offset range must be 130±20° C.

(c) Fixing Strength

Figure 4:
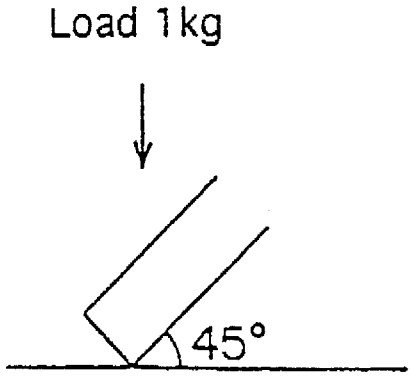
FIG. 4 illustrates the method of measuring fixing strength.

Toner images were fixed with the roller temperature set at 130° C., and the portion at which image density ID was within a range of 1.35~1.45 was erased with a rubber eraser with three reciprocal strokes as shown in FIG. 4. Thereafter, the ID density was measured and fixing strength calculated using the expressions below. A fixing strength of 85% or greater is required. In Table 2, the symbol [—] indicates offset occurred, and measurement was impossible because the transfer sheet wrapped around the fixing roller.

$$\text{Fixing strength}=(\text{post erasure ID})/(\text{pre-erasure ID})\times 100\ (\%)$$

Fixing strength measured by above-mentioned procedure is shown in Table 2.

Experimental Example 2

Toner particles B were produced in the same manner as in experimental example 1 with the exception that the offset preventing agents below were substituted for those used in experimental example 1. In this toner, heat fluctuation difference $\Delta H_2-\Delta H_3$ was measured by DSC in the same manner as in experimental example 1, and the data are shown in Table 1.

| | Parts-by-weight |
|---|---|
| First offset preventing agent (Fischer-Tropsch wax C-60; softening point 100° C.; acid value 28; Kato Yoko Co.) | 2 |
| Second offset preventing agent (Biscol TS-200B; softening point 136° C.; acid value 5.9; Sanyo Kasei K.K.) | 1 |

Evaluations were performed in the same manner as described in experimental example 1; results are shown in Table 2. Excellent results were obtained in continuous printing tests performed in the same manner as described in experimental example 1.

Experimental Example 3

Toner particles C were produced in the same manner as in experimental example 1 with the exception that the offset preventing agents below were substituted for those used in experimental example 1. In this toner, heat fluctuation difference $\Delta H_2-\Delta H_3$ was measured by DSC in the same manner as in experimental example 1, and the data are shown in Table 1.

| | Parts-by-weight |
|---|---|
| First offset preventing agent Fischer-Tropsch wax (Sazol A1; softening point 90° C.; acid value 28; Kato Yoko Co.) | 3 |
| Second offset preventing agent (Hoechst wax PED121; softening point 116° C.; acid value 17; Sanyo Kasei K.K.) | 1 |

Evaluations were performed in the same manner as described in experimental example 1; results are shown in Table 2. Excellent results were obtained in continuous printing tests performed in the same manner as described in experimental example 1.

Experimental Example 4

Toner particles D were produced in the same manner as in experimental example 1 with the exception that the offset preventing agents below were substituted for those used in experimental example 1. In this toner, heat fluctuation difference $\Delta H_2-\Delta H_3$ was measured by DSC in the same manner as in experimental example 1, and the data are shown in Table 1.

| | Parts-by-weight |
|---|---|
| First offset preventing agent (Sanwax E-250P; softening point 104° C.; acid value 20; Sanyo Kasei K.K.) | 2 |
| Second offset preventing agent (Biscol TS-200; softening point 145° C.; acid value 3.5; Sanyo Kasei K.K.) | 1 |

Evaluations were performed in the same manner as described in experimental example 1; results are shown in Table 2. Excellent results were obtained in continuous printing tests performed in the same manner as described in experimental example 1.

Experimental Example 5

Toner particles E were produced in the same manner as in experimental example 1 with the exception that the offset preventing agents below were substituted for those used in experimental example 1. In this toner, heat fluctuation difference $\Delta H_2-\Delta H_3$ was measured by DSC in the same manner as in experimental example 1, and the data are shown in Table 1.

| | Parts-by-weight |
|---|---|
| First offset preventing agent (Hiwax 110; softening point 100° C.; Mitsui Sekiyu Kagaku K.K.) | 3.5 |
| Second offset preventing agent (Biscol 550P; softening point 150° C.; Sanyo Kasei K.K.) | 1.5 |

Evaluations were performed in the same manner as described in experimental example 1; results are shown in Table 2. Excellent results were obtained in continuous printing tests performed in the same manner as described in experimental example 1.

Experimental Example 6

Toner particles F were produced in the same manner as in experimental example 1 with the exception that the first offset preventing agent of example 1 was omitted. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, low-temperature offset occurred from the start, and testing was interrupted by the transfer sheets wrapping around the fixing roller.

Experimental Example 7

Toner particles G were produced in the same manner as in experimental example 1 with the exception that the second offset preventing agent was omitted. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, high-temperature offset occurred several sheets after the start, but thereafter excellent results similar to the results of experimental example 1 were obtained.

Experimental Example 8

Toner particles H were produced in the same manner as in experimental example 1 with the exception that 1.0 parts-by-weight Fischer-Tropsch wax (Sazol A2, softening point 97° C.; acid value 11) was substituted for second offset preventing agent. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, low-temperature offset occurred from the start, and testing was interrupted by the sheet wrapping around the fixing roller.

Experimental Example 9

Toner particles I were produced in the same manner as in experimental example 1 with the exception that 1.0 parts-by-weight Biscol 660P (softening point 145° C.) was substituted for first offset preventing agent. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, low-temperature offset occurred from the start, and testing was interrupted by sheets wrapping around the fixing roller.

Experimental Example 10

Toner particles J were produced in the same manner as in experimental example 1 with the exception that 0.5 parts-by-weight first offset preventing agent and 1.5 parts-by-weight second offset preventing agent were used. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, low-temperature offset occurred from the start, and testing was interrupted by sheets wrapping around the fixing roller.

Experimental Example 11

Toner particles K were produced in the same manner as in experimental example 1 with the exception that 1.0 parts-by-weight first offset preventing agent and 1.0 parts-by-weight second offset preventing agent were used. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, low-temperature offset occurred from the start, and testing was interrupted by sheets wrapping around the fixing roller.

Experimental Example 12

Toner particles L were produced in the same manner as in experimental example 1 with the exception that 4 parts-by-weight first offset preventing agent and 0.5 parts-by-weight second offset preventing agent were used. In this toner, heat fluctuation difference $\Delta H_2-\Delta H_3$ was measured by DSC in the same manner as in experimental example 1, and the data are shown in Table 1. Evaluations were performed in the same manner as described in experimental example 1; results are shown in Table 2. In continuous printing tests, high-temperature offset occurred for several sheets from the start, but excellent results similar to the results of experimental example 1 were obtained thereafter.

TABLE 1

| | Toner | $\Delta H_2$-$\Delta H_3$ |
|---|---|---|
| Example 1 | A | 0.63 |
| Example 2 | B | 0.78 |
| Example 3 | C | 0.83 |
| Example 4 | D | 0.76 |
| Example 5 | E | 1.04 |
| Example 6 | F | −0.22 |
| Example 7 | G | 0.15 |
| Example 8 | H | 0.51 |
| Example 9 | I | −0.18 |
| Example 10 | J | −0.12 |
| Example 11 | K | −0.17 |
| Example 12 | L | 1.63 |

$\Delta H_2$: Amount of heat fluctuation of first offset preventing agent measured by DSC
$\Delta H_3$: Amount of heat fluctuation of first offset preventing agent measured by DSC

TABLE 2

| | Toner | Non-offset range (°C.) | Fixing Strength |
|---|---|---|---|
| Ex. 1 | A | 110~200 | 87% |
| Ex. 2 | B | 105~200 | 90% |
| Ex. 3 | C | 100~205 | 93% |
| Ex. 4 | D | 105~200 | 89% |
| Ex. 5 | E | 100~205 | 92% |
| Ex. 6 | F | 160~200 | — |
| Ex. 7 | G | 125~145 | 88% |
| Ex. 8 | H | 130~160 | — |
| Ex. 9 | I | 165~220 | — |
| Ex. 10 | J | 145~205 | — |
| Ex. 11 | K | 140~180 | — |
| Ex. 12 | L | 125~140 | 75% |

Experimental Example 13

(1) Production of low-molecular weight polyester resin

A reflux condenser, moisture separator, $N_2$ gas tube, and mixing device were attached to a 5 liter capacity 4-mouth flask and installed on a mantle heater, and 1,376 g of bisphenol propylene oxide, and 443 g of isophthalic acid were introduced to the flask. As $N_2$ gas was introduced to the flask, the material was subjected to dehydration polycondensation at 220° C. to 270° C., to obtain a low-molecular weight polyester resin (Mw: 4,000; Tg: 58° C.).

(2) Production of polyester resin for further polymerization

A reflux condenser, moisture separator, $N_2$ gas tube, and mixing device were attached to a 5 liter capacity 4-mouth flask and installed on a mantle heater, and 1,720 g of bisphenol propylene oxide, 1,028 g of isophthalic acid, 328 g of 1,6-dipropyl-1,6-hexane diol, and 74.6 g of glycerin were introduced to the flask. As gas was introduced to the flask, the material was subjected to dehydration polycondensation at 240° C. to obtain a polyester resin for further polymerization (Mw: 6,800; Tg: 38° C.).

(3) Production of urethane-modified polyester resin

To 80 parts-by-weight of said low-molecular weight resin was added 20 parts-by-weight of said polyester resin for further polymerization, and the materials were uniformly dry blended by henschel mixer. Then, 40 parts-by-weight diphenylmethane-4,4-diisocyanate was added and reacted for 1 hr at 120° C. by a heating kneader to obtain a urethane-modified polyester resin having a glass transition temperature (Tg) of 59° C. and acid value of 28. The obtained polyester resin was used s a binder resin in the toner described below.

(4) Toner production

| | Parts-by-weight |
|---|---|
| Urethane-modified polyester resin | 100 |
| Carbon black (Mogul L; Cabot Co.) | 5 |
| Charge-controlling agent (S-34; Oriental Chemicals K.K.) | 2 |
| First offset preventing agent (Carnauba wax; softening point 85° C. | 1.5 |

-continued

| | Parts-by-weight |
|---|---|
| acid value 4; Kato Yoko Co.) | |
| Second offset preventing agent (Biscol TS-200; softening point 145° C. acid value 3.5; Sanyo Kasei K.K.) | 1.0 |

The aforesaid materials were mixed using a henschel mixer, then kneaded using a twin-shaft extrusion kneader. The kneaded material was cooled, and coarsely pulverized, then finely pulverized using a jet mill type fine pulverization device. The obtained finely pulverized material was classified using a forced air classification device to obtain particles having a mean particle size of 8.6 μm (3.8% less than 5μ, and 0% greater than 20 μm). To the aforesaid particles was added 0.5 parts-by-weight hydrophobic silica H-2000 (Hoechst Co.), and the material was mixed in a henschel mixer for 60 sec at 2,500 rpm to produce toner particles M.

(5) Evaluations (a) Continuous Printing Test

Continuous printing tests were performed in the same manner as described in experimental example 1. Excellent image quality was obtained from the start through 6,000 printings without offset or soiling of the fixing roller, and without wrapping of the transfer sheet on the fixing roller.

Image density, fogging, and filming were also evaluated every 2,000 printings. Image density was measured using a Sakura densitometer (Konica Co., Ltd.), and results were ranked as indicated below. A rank of ○ indicates desirable results, although a ranking of Δ or higher poses no problem from a practical standpoint.

○: Image density of 1.40 or higher
Δ: Image density of 1.35 or higher, but less than 1.40
X: Image density of less than 1.35
–: Impossible to measure due to offset Fogging was evaluated by visual inspection of the produced images, and rankings are described below.

○: No fog
Δ: Slight fogging, but not a problem for practical use
X: Fogging is problematic from a practical standpoint
–: Impossible to evaluate due to offset Filming was evaluated by .visual inspection of the developing sleeve surface, and rankings are described below.

○: No filming
Δ: Slight filming, but not a problem for practical use
X: Filming is problematic from a practical standpoint
–: Impossible to measure due to offset Non-offset range and fixing strength were evaluated in the same manner as described in experimental example 1; the results are shown in Table 4. When the fixing temperature was 130° C., the non-offset range exhibiting no problem from a practical use perspective was 130° C.±20° C.; when the fixing temperature was 170° C., the non-offset range was 170° C.±20° C.

Non-offset range and printing resistance characteristics evaluated by fixing test are shown in Tables 3 and 4.

Experimental Example 14

Toner particles N were produced in the same manner as in experimental example 13 with the exception that the offset preventing agents were changed as indicated below.

| | Parts-by-weight |
|---|---|
| *First offset preventing agent (Rice wax No.1; softening point 82° C.; acid value 7; Noda wax Co.) | 2.0 |
| *Second offset preventing agent (Biscol TS-200; softening point 145° C.; acid value 3.5; Sanyo Kasei K.K.) | 1.5 |

Toner particles N were evaluated in the same manner as described in experimental example 13. Non-offset range and print resistance evaluation results are shown in Tables 3 and 4.

Experimental Example 15

Toner particles O were produced in the same manner as in experimental example 13 with the exception that the offset preventing agents were changed as indicated below.

| | Parts-by-weight |
|---|---|
| *First offset preventing agent Fischer-Tropsch wax (Sazol A7; softening point 90° C.; acid value 27; Kato Yoko Co.) | 2.0 |
| *Second offset preventing agent (Hoechst Wax PED121; softening point 115° C.; acid value 17; Hoechst Co.) | 1.0 |

Toner particles O were evaluated in the same manner as described in experimental example 13. Non-offset range and print resistance evaluation results are shown in Tables 3 and 4.

Experimental Example 16

(1) Polyester Resin Synthesis

A reflux condenser, moisture separator, $N_2$ gas tube, and mixing device were attached to a 5-liter capacity 4-mouth flask and installed on a mantle heater, and 200 g of bisphenol ethylene oxide, 490 g bisphenol propylene oxide, and terephthalic acid were introduced to the flask. As $N_2$ gas was introduced to the flask, the material was subjected to dehydration polycondensation at 200° C. Thereafter, 120 g of anhydrous 1,2,4-benzene tricarboxylic acid were added and reacted to obtain a polyester resin (softening point 121° C.; Tg 63° C.; acid value 38). This polyester resin was used as the binder resin in the toners described below.

(2) Toner Production

| | Parts-by-weight |
|---|---|
| Aforesaid polyester resin | 100 |
| Carbon black (Mogul L; Cabot Co.) | 5 |
| Charge-controlling agent (E-81; Oriental Chemicals K.K.) | 3 |
| First offset preventing agent (Hiwax 4202E; softening point 108° C.; acid value 16; Mitsui Sekiyu Kagaku) | 1.0 |
| Second offset preventing agent (TS-200B; softening point 136° C.; acid value 5.9; Sanyo Kasei K.K.) | 3.0 |

Toner particles P were produced in the same manner as described in experimental example 13.

Toner particles P were then evaluated in the same manner as described in experimental example 13. Non-offset range and print resistance evaluation results are shown in Tables 3 and 4.

Experimental Example 17

Toner particles Q were produced in the same manner as in experimental example 13 with the exception that second offset preventing agent was not added.

Then, toner particles Q were evaluated in the same manner as in experimental example 13. Non-offset range and print resistance results are shown in Tables 3 and 4.

Experimental Example 18

Toner particles R were produced in the same manner as in experimental example 13 with the exception that first offset preventing agent was not added.

Then, toner particles R were evaluated in the same manner as in experimental example 13. Offset preventing range and print resistance results are shown in Tables 3 and 4.

Experimental Example 19

Toner particles S were produced in the same manner as in experimental example 13 with the exception that Biscol 550P (softening point 145° C.; acid value 0; Sanyo Kasei K.K.) was substituted for second offset preventing agent.

Then, toner particles S were evaluated in the same manner as in experimental example 13. Non-offset range and print resistance results are shown in Tables 3 and 4.

Experimental Example 20

Toner particles T were produced in the same manner as in experimental example 15 with the exception that Fischer-Tropsch wax (Sazol Hi; softening point 108° C.; acid value 0; Kato Yoko Co.) was substituted for first offset preventing agent.

Then, toner particles T were evaluated in the same manner as in experimental example 13. Non-offset range and print resistance results are shown in Tables 3 and 4.

Experimental Example 21

Toner particles U were produced in the same manner as in experimental example 15 with the exception that Hiwax 110 (softening point 110° C.; acid value 0; Mitsui Sekiyu Kagaku) was substituted for first offset preventing agent, and Hiwax 400 (softening point 132° C.; acid value 0) was substituted for second offset preventing agent.

Then, toner particles U were evaluated in the same manner as in experimental example 13. Non-offset range and print resistance results are shown in Tables 3 and 4.

TABLE 3

| | Toner | Non-offset range | Fixing strength (130° C.) | Fixing strength (170° C.) |
|---|---|---|---|---|
| Ex 13 | M | 110° C.–200° C. | 88% | 100% |
| Ex 14 | N | 105° C.–195° C. | 91% | 100% |
| Ex 15 | O | 105° C.–200° C. | 90% | 100% |
| Ex 16 | P | 110° C.–205° C. | 87% | 100% |
| Ex 17 | Q | 110° C.–155° C. | 88% | - *2 |
| Ex 18 | R | 160° C.–200° C. | - *1 | 87% |
| Ex 19 | S | 110° C.–200° C. | 89% | 100% |
| Ex 20 | T | 115° C.–205° C. | 86% | 100% |
| Ex 21 | U | 105° C.–200° C. | 88% | 100% |

TABLE 4

| | | Printing Test | | | | | | | | | | | | | | | | | |
|---|---|---|---|---|---|---|---|---|---|---|---|---|---|---|---|---|---|---|---|
| | | 2000 sheets | | | | | | 4000 sheets | | | | | | 6000 sheets | | | | | |
| | | Image density | | Fogging | | Filming | | Image density | | Fogging | | Filming | | Image density | | Fogging | | Filming | |
| | Toner | 130° C. | 170° C. | 130° C. | 170° C. | 130° C. | 170° C. | 130° C. | 170° C. | 130° C. | 170° C. | 130° C. | 170° C. | 130° C. | 170° C. | 130° C. | 170° C. | 130° C. | 170° C. |
| Ex. 13 | M | ○ | ○ | ○ | ○ | ○ | ○ | ○ | ○ | ○ | ○ | ○ | ○ | ○ | ○ | ○ | ○ | ○ | ○ |
| Ex. 14 | N | ○ | ○ | ○ | ○ | ○ | ○ | ○ | ○ | ○ | ○ | ○ | ○ | ○ | ○ | ○ | ○ | ○ | ○ |
| Ex. 15 | O | ○ | ○ | ○ | ○ | ○ | ○ | ○ | ○ | ○ | ○ | ○ | ○ | ○ | ○ | ○ | ○ | ○ | ○ |
| Ex. 16 | P | ○ | ○ | ○ | ○ | ○ | ○ | ○ | ○ | ○ | ○ | ○ | ○ | ○ | ○ | ○ | ○ | ○ | ○ |
| Ex. 17 | Q | ○ | — | ○ | — | ○ | — | ○ | — | ○ | — | ○ | — | ○ | — | Δ | — | Δ | — |
| Ex. 18 | R | — | ○ | — | ○ | — | ○ | — | ○ | — | ○ | — | ○ | — | ○ | — | ○ | — | Δ |
| Ex. 19 | S | ○ | ○ | ○ | ○ | Δ | Δ | Δ | Δ | Δ | Δ | X | X | X | X | X | X | X | X |
| Ex. 20 | T | Δ | Δ | X | X | X | X | X | X | X | X | X | X | X | X | X | X | X | X |
| Ex. 21 | U | X | X | X | X | X | X | X | X | X | X | X | X | X | X | X | X | X | X |

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A developer for use in an image forming apparatus which forms an electrostatic latent image on an electrostatic latent image carrying member, develops said latent image by a developer provided from a developing device, transfers an image obtained by the developing onto a recording member and fixes the image on the recording member by a heat roll fixing device, said developer comprising a toner including a binder resin, a colorant and first and second offset preventing agents, and wherein the total amount of said first and second offset preventing agents is in the range of from 2 to 7 parts by weight per 100 parts by weight of the binder resin, and the softening points of said binder resin ($Tm_1$), of said first offset preventing agent ($Tm_2$) and of said second offset preventing agent ($Tm_3$) satisfy the following relationship:

$$Tm_2 < Tm_1 \leqq Tm_3 \quad \text{(I)}$$

and the heat quantity change of said first offset preventing agent ($\Delta H_2$) and of the second offset preventing agent ($\Delta H_3$) satisfy following relationship:

$$0.20\ (\text{mJ/mg}) \leqq \Delta H_2 - \Delta H_3 \leqq 1.50\ (\text{mJ/mg}) \quad \text{(II)}$$

when said heat quantity changes are measured by a differential scanning calorimeter.

2. The developer as claimed in claim 1 wherein said first and second offset preventing agents each have an endothermic peak within the range of from 80° to 150° C. in a differential scanning calorimetry curve.

3. The developer as claimed in claim 1 wherein $Tm_1$ is in the range of from 80° to 140° C., $Tm_2$ is in the range of from 60° to 110° and $Tm_3$ is in the range of from 110° to 150° C.

4. The developer as claimed in claim 3 wherein $Tm_1$ is in the range of from 90° to 130° C. $Tm_2$ is in the rage of from 80° to 100° C. and $Tm_3$ is in the range of from 130° to 150° C.

5. The developer as claimed in claim 3 wherein $Tm_2 \leqq Tm_1 - 10°$ C. and $Tm_3 \geqq Tm1 + 10°$.

6. The developer as claimed in claim 1 wherein said first offset preventing agent is contained in an amount of from 1 to 6 parts by weight per 100 parts by weight of the binder resin and said second offset preventing agent is contained in an amount of from 0.5 to 5 parts by weight per 100 parts by weight of the binder resin.

7. The developer as claimed in claim 1 wherein said first offset preventing agent contains at least one compound selected from the group consisting of carnauba wax, Fischer-Tropsch wax, rice wax, candelilla wax, jojoba oil wax, beeswax, polyethylene wax and oxidized polyethylene wax.

8. The developer as claimed in claim 1 wherein said second offset preventing agent contains at least one compound selected from the group consisting of polyethylene wax, polypropylene wax, oxidized polyethylene wax and oxidized polypropylene wax.

9. The developer as claimed in claim 1 wherein said toner further comprising a fluidizing agent treated by a hydrophobic agent selected from the group consisting of silane coupling agent, titanium coupling agent, higher fatty acid and silicone oil, said fluidizing agent being mixed with the toner and amount of said fluidizing agent being in the range of 0.05 to 5 parts by weight per 100 parts by weight of the toner.

10. The developer as claimed in claim 1 wherein said developing device comprises a monocomponent developing device.

11. The developer as claimed in claim 10 wherein said developing device accommodates non-magnetic monocomponent developer.

12. The developer as claimed in claim 1 wherein said heat roll fixing device has a pair of rollers having a diameter of 25 mm or less.

13. The developer as claimed in claim 12, wherein said heat rollers have different diameters.

14. The developer as claimed in claim 1, wherein said image forming apparatus includes a developing device which performs contact developing against an electrostatic latent image carrying member, said developing device having means for withdrawing residual toner and means for developing electrostatic latent images.

15. A toner comprising:

a binder resin comprising a polyester resin made of etherified diphenol and dicarboxylic acid, said polyester resin having a glass transition point in the range of from 55° to 70° C. and a softening point in the range of from 80° to 140° C.;

a colorant;

a first offset preventing agent having a softening point in the range of from 60° to 110° C. and being present in an amount in the range of from 1 to 6 parts by weight per 100 parts by weight of said binder resin; and a second offset preventing agent having a softening point in the range of from 110° to 150° C. and being present in an amount in the range of from 0.5 to 5 parts by weight, said first offset preventing agent being present in an amount which is greater than said second offset preventing agent, and wherein the softening point of said binder resin (Tm1), of said first offset preventing agent (Tm2) and of said second offset preventing agent (Tm3) satisfy the following relationship:

$$Tm_2 < Tm_1 \leqq Tm_3 \quad \text{(I).}$$

16. The toner as claimed in claim 15 wherein $Tm_1$ is in the range of from 90° to 130° C., $Tm_2$ is in the range of from 80° to 100° C. and $Tm_3$ is in the range of from 130° to 150° C.

17. The toner as claimed in claim 15 wherein $Tm_2 \leqq Tm_1 - 10°$ and $Tm_3 \geqq Tm1 + 10°$.

18. The toner as claimed in claim 15 wherein said first offset preventing agent is present in an amount in the range of from 2 to 5 parts by weight per 100 parts by weight and said second offset preventing agent is present in an amount in the range of from 1 to 3 parts by weight per 100 parts by weight of the binder resin.

19. A toner comprising:

a binder resin comprising polyester resin made of etherified diphenol and dicarboxylic acid, said polyester resin having an acid value in the range of from 15 to 50;

a colorant;

a first offset preventing agent having a softening point in the range of from 60° to 110° C. and an acid value of from 3 to 45; and a second offset preventing agent having a softening point in the range of from 110° to 150° C. and an acid value in the range of from 1 to 30.

20. The toner as claimed in claim 19 wherein said acid value of the polyester resin is in the range of from 20 to 40, that of the first offset preventing agent is in the range of from 3 to 35 and that of the second offset preventing agent is in the range of from 1 to 30.

21. The toner as claimed in claim 19 wherein said first offset preventing agent is present in amount in the range of from 1 to 6 parts by weight per 100 parts by weight of the binder resin and said second offset preventing agent is present in an amount in the range of from 0.5 to 5 parts by weight per 100 parts by weight of the binder resin.

22. The toner as claim in claim 19 wherein said first offset preventing agent comprises at least one compound selected from the group consisting of carnauba wax, Fischer-Tropsch wax, rice wax, candelilla wax, jojoba oil wax, beeswax, and oxidized polyethylene wax.

23. The developer as claimed in claim 19, wherein said second offset preventing agent comprises at least one compound selected from the group consisting of oxidized polyethylene wax and oxidized polypropylene wax.

24. The developer as claimed in claim 19 wherein said first offset preventing agent is present in an amount which is greater that the amount of said second offset preventing agent.

25. The developer as claimed in claim 24 wherein the first offset preventing agent has an acid value larger than that the acid value of the second offset preventing agent.

26. The developer as claimed in claim 15 wherein said toner further comprising a fluidizing agent treated by a hydrophobic agent selected from the group consisting of silane coupling agent, titanium coupling agent, higher fatty acid and silicone oil, said fluidizing agent being mixed with the toner and wherein said fluidizing agent is present in the range of from 0.05 to 5 parts by weight per 100 parts by weight of the toner.

27. The developer as claimed in claim 19 wherein said toner further comprising a fluidizing agent treated by a hydrophobic agent selected from the group consisting of silane coupling agent, titanium coupling agent, higher fatty acid and silicone oil, said fluidizing agent being mixed with the toner and wherein said fluidizing agent is present in the range of from 0.05 to 5 parts by weight per 100 parts by weight of the toner.

* * * * *